US005655323A

United States Patent [19]

Lassoff

[11] Patent Number: 5,655,323

[45] Date of Patent: Aug. 12, 1997

[54] MESSAGE BOARD

[76] Inventor: Steven Ira Lassoff, 2465 Gillingham Cir., Thousand Oaks, Calif. 91362

[21] Appl. No.: 419,243

[22] Filed: Apr. 10, 1995

[51] Int. Cl.[6] ..... G09F 7/02

[52] U.S. Cl. ..... 40/611; 40/661

[58] Field of Search ..... 40/661, 120, 611

[56] References Cited

U.S. PATENT DOCUMENTS

| | | | |
|---|---|---|---|
| 304,806 | 9/1884 | Downs | 40/120 X |
| 3,696,532 | 10/1972 | Nahon | 40/661 |
| 4,171,584 | 10/1979 | Kaiser | 40/661 X |
| 4,240,543 | 12/1980 | McKee | 40/661 X |
| 4,283,869 | 8/1981 | Rappa | 40/661 |
| 5,309,659 | 5/1994 | Eastman | 40/661 X |
| 5,388,739 | 2/1995 | Gargan | 40/661 X |

*Primary Examiner*—Joanne Silbermann
*Attorney, Agent, or Firm*—Paul Adams

[57] ABSTRACT

A message or note board that is also a holder for mail constructed of recycled plastic material and assembled from several different types of plastic but easily disassembled with common hand tools so that after final use, the parts may be segregated for further recycling. The noteboard has a flat plastic backing or plate that can be attached to a wall or a door on a refrigerator. Attached to the front surface is a transparent sheet that can be written on with a dry-erasable pen. A sheet of paper may be inserted between the transparent sheet and the backing plate and contains information. The lower end of the plate has an L-shaped tray or ledge that supports mail.

1 Claim, 1 Drawing Sheet

MESSAGE BOARD

BACKGROUND-FIELD OF INVENTION

This invention relates to message board that is used for recording short messages using a dry erase pen. The board can be conveniently mounted in a home, office or factory. It is designed to be environmentally friendly.

DESCRIPTION OF THE PRIOR ART

There are in common use, in homes, offices and factories, many types of message boards that can be used for handy recording of short messages, such as one taken over the telephone that contains only the party's name and number. One common device simply attaches to a wall or vertical surface and comprises a multi-page paper pad on which a message may be written with a pencil or pen. One construction of these noteboards that has become popular is the provision of a magnet on the rear surface of the pad that allows the pad to be attached to a metallic refrigerator door in the kitchen of a home.

There are also in common use so-called "Whiteboards" that are used primarily in offices and business areas for temporarily recording information, These boards have an opaque surface and are written on using a dry-erase pen that deposits ink on the surface. The Whiteboard surface is designed to retain the ink but to also allow the ink to be easily wiped off using a cloth or paper tissue or similar dry eraser. Such devices are also made with permanent recorded information on the surface that is painted, stenciled or otherwise applied. Such information may include a calendar showing the days of a month, or months of the year which may then be used to record, using the dry-erase pen, additional hand written information relative to appointments, scheduling, or the like. The white board permanent information may also contain an advertising message or the name of a company, with an address and telephone number to promote the company's services or products.

Many of these message devices are constructed from plastic coated material, for example, using a backing board to provide rigidity to the device that is a hard, rigid plastic. Since millions of these devices are in use, it is apparent that there is a waste of plastic material when these devices are thrown away after final use, and because of the low cost, they are thrown away frequently. With increasing awareness of the limited resources of the Earth that are available for man's use, most consumers recognize that they should not simply discard devices, such as the plastic message boards described above, as refuse, because the materials may be recycled. But the institutions that provide recycling services can do so only when the materials can be segregated into specific types, because different materials are recycled by different processes and by different entities.

One disadvantage of the devices described above is that they are not manufactured with proper regard for the environment, and even if they use recycled materials they do not permit easy separation of the materials from which they are made so as to allow the materials to be recycled at reasonable expense.

Another disadvantage of the message boards mentioned above is that they use paper which is a scarce and precious resource.

Still another disadvantage of prior art message boards is that when such message boards are made using a whiteboard, the information that is printed on the board is permanent and may not be changed during the life of the board.

OBJECTS AND ADVANTAGES

It is therefore one advantage of the present invention to make a low cost message board that is environmentally friendly. Specifically, the message board is made from recyclable materials as far as possible and is constructed or assembled from different types of plastic materials but can be easily disassembled so that after final use the components can be separated and individually recycled.

Another advantage of the invention is that it utilizes a dry-erase type of writing sheet having a film that are both transparent, rather than opaque. The writing sheet is attached to a rigid board such that a sheet of paper with printed information can be inserted between the two, so that the information can be changed during the life of the board increasing its utility.

Other advantages and benefits of the invention are disclosed in the following detailed description.

DESCRIPTION OF THE PREFERRED EMBODIMENT

Figure 1:
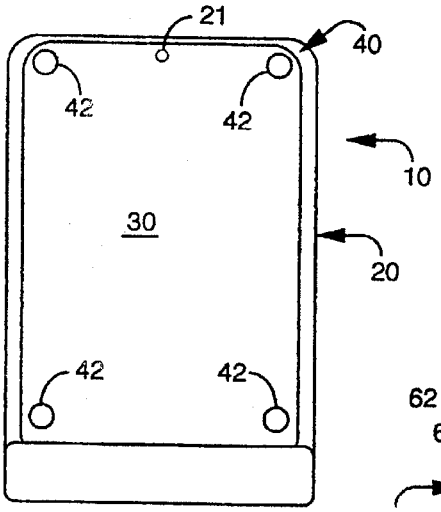
FIG. 1 is front view of a preferred embodiment of a message board constructed in accordance with the present invention.
Figure 2:
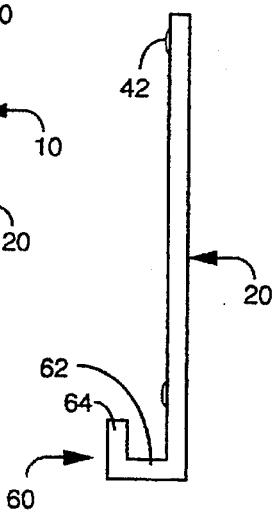
FIG. 2 is a side view.
Figure 3:
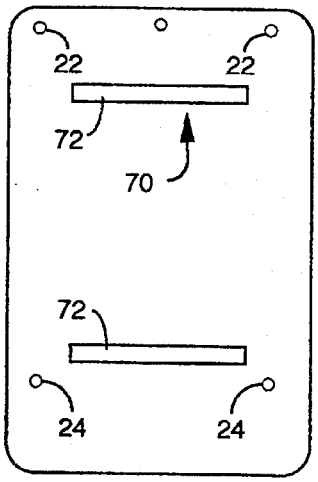
FIG. 3 is rear view.

Referring now to FIGS. 1 through 3, there is shown a message board, or noteboard 10 that is combined with a mail holder. The message board 10 includes a rigid board 20, a transparent sheet 30, means 40 for attaching the sheet to the board, information carrying means 50 means for holding mail 60, and means 70 for attaching the message board to a vertical surface.

The rigid board 20 provides structural strength to the message board 10. The board or plate 20 is flat and rectangular in shape. It may be of various sizes, although a size of generally 8 inches by 12 inches is convenient and practical. The board is constructed from recycled plastic material that is post-consumer, i.e. the material was previously used in an object that was sold to a consumer, used for its purpose, and then discarded such that the object was converted into raw plastic material that was subsequently used in a new product. The material may be, for example, polystyrene.

The board 20 is adapted to be hung in a vertical position on a vertical wall, although it will be appreciated that the board could be used on a desk, kitchen counter, or any horizontal surface. The board may be hung vertically from hole 21. The board is provided with at least two identical holes at the upper end, 22, as seen best in FIG. 3. There may be two additional holes 24 toward the lower end of the board 20, also.

Figure 5:
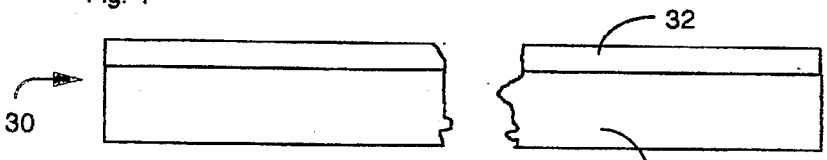
FIG. 5 is cross-sectional view of the transparent sheet of the invention.

The transparent sheet 30 is constructed from a material, or several materials, the front surface of which is suitable for writing on with a dry-erase pen in common use with so-called Whiteboards. One example would be the Sanford Corp. dry erase marker that is described in Pat. No. 3,089,182. The sheet 30 in the preferred embodiment is made as a laminate, as shown in FIG. 5, in which the front surface is a film 32 such as that available from Kepco Adhesive Products Co., Kent, Ohio 44240 (Product No. 7093). This film is highly flexible being of a thickness that is less than one mil. To provide some strength and body to the sheet, the film 32 is laminated to a heavier material, also transparent, about 2 mil thick, such as Mylar, the trade name of the polyester material available from duPont. While the specific thickness, single or multiple layers, or material of the sheet 30 is not critical to the invention, the surface of the sheet 30 must be capable of accepting dry-erase ink and easily cleaned with a cloth or paper tissue and the sheet must be transparent.

The transparent sheet in the preferred embodiment shown is provided with two holes 36 that are in registry with the two holes in the upper end of the board 20. Two additional holes may be provided at the lower end of the sheet to register with holes 24 in the backing plate 20.

Figure 4:
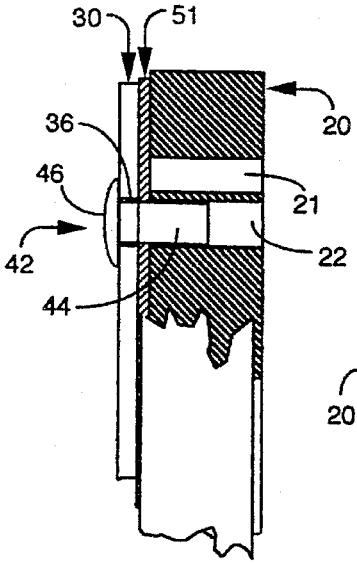
FIG. 4 is an enlarged section view of one portion of the message board.

The sheet 30 is attached to the board 20 by means 40 which includes the above-described holes 22 in the board 20 and identical and registered holes in the sheet 30 and the plugs 42, one of which is seen in FIG. 4 in detail. The plug 42 has a cylindrical body 44 that is of the same approximate diameter as the holes 22. A head 46 is integrally formed at one end of the plug 42. The material of the plug may be polypropylene plastic. The plug is sufficiently malleable such that if it is made slightly larger in diameter than the hole 22, it may be press fit into the hole so as to secure the sheet 30 to the board 20. When the message board 10 is to be discarded after final use, the plugs 40 may be easily pushed out of the holes from the rear of the board with a pencil or a suitable hand tool that is readily available to a consumer at low cost.

A second pair of plugs 42 may be used to fasten the lower end of sheet 30 to the board 20 to maintain the sheet 30 in flat condition suitable for writing on with the dry-erase pen.

The information carrying means 50 in the preferred embodiment is a sheet of paper 51. The sheet is inserted between the transparent sheet 30 and the rigid board 20 and is therefore readable from the front of the message board. The sheet 51 may be slightly narrower than the distance between the two plugs so that it can be easily inserted from the top of the message board after the sheet 30 is attached to the board 20. Of course, the sheet 51 could be permanently secured to the board 20 by the provision of registered holes with the holes 20 so that the sheet is attached when the message board is assembled. The sheet 51 could also be insertable after assembly of the noteboard from the side. The sheet 51 could also be made of plastic or any material on which information may be printed, stenciled, silk-screened, or the like.

The information on sheet 51 could also be printed directly onto the surface of the board 20, if it was desirable to make the information a permanent part of the message board. But this may require a use of a plastic material for the board 20 that is not conducive to recycling. Moreover, the use of a separate sheet 51 allows different messages or information to be printed and inserted, from time to time, to change the message. For example, a series of sheets 51 could be provided with the message board, each having a different month of the year, so that the message board constitutes a calendar, on which notes could be recorded at the appropriate dates with the dry-erase pen.

Figure 6:
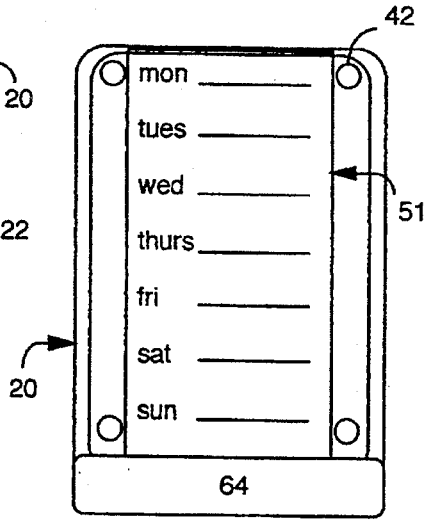
FIG. 6 shows the message board with an information sheet inserted behind the transparent sheet.
Figure 7:
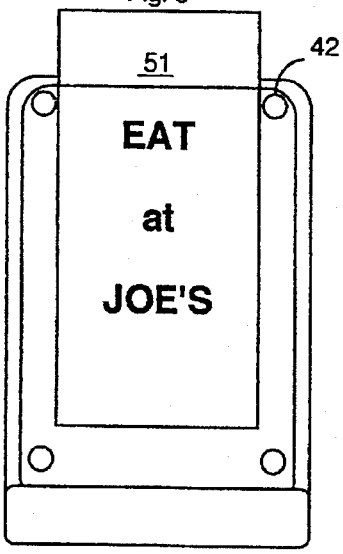
FIG. 7 is a view similar to FIG. 6 except with an alternative information sheet.

The sheet 51 could also be printed with a template such as that shown in FIG. 6 for the days of the week, with a visual aid such as a line that will guide the user to record notes in the appropriate part of the sheet. Of course, the notes may be easily erased at the start of each week. Alternatively, the sheet 51 could carry an advertisement as seen in FIG. 7 where the sheet is partially inserted into the space between the transparent sheet 30 and the back 20. For the manufacturer of the message board, the ability to insert different sheets 51 after the board 20 is assembled, allows it to make message boards with advertisements customized to order. This reduces the need for large order runs so smaller advertisers would be interested in purchasing the message boards as a premium item.

The mail holding means 60 may be formed integrally with the board 20 or may be separately constructed and attached, permanently or temporarily. The means 60 includes a member 62 that extends outwardly from the board 20 to provide a ledge or support for mail envelopes. The member 62 may extend the entire width of the board 20 or only some portion thereof. A short vertical member 64 projects upwardly from the ledge 62 to retain the envelopes, i.e. prevent them from sliding off the ledge. The member 64 may also extend the entire width of the board 20 or only some portion thereof.

The message board 10 may be removably attached to a wall or metallic surface through means 70 that in the preferred embodiment may comprise one or more magnets 72. Such magnets are well known in the art and may be attached to the rear surface of the board 20 by adhesive or the like. The device 10 could also be hung from a nail in hole 21 in the board 20 at the upper end or in any manner well known in the art for hanging devices on a wall or other vertical surface.

From the above description, it will be appreciated that the objects of the invention are attained through the preferred embodiment described herein in detail. However, it should also be appreciated that various changes may be made in the construction and materials of the message board 10 while retaining the advantages of the invention. For example, the shape of the board 20 may be square, round, or irregular, such as a shape of a character or other object. The size may be made much larger or smaller than that described. The sheet 30 may be attached to the board 20 by clips, adhesive, or other means. The message board may be used horizontally and thus the mail holder may be eliminated or otherwise configured. In short, the above description should not be construed as limiting the scope of the invention but as merely an illustration of one form of the invention. Thus the scope of the invention should be determined by the following claims, and the equivalents of the elements and means contained in such claims.

I claim:

1. A message board on which messages may be written using a dry-erase pen including:

a) a flat, rigid plastic board including an integral edge at the lower end thereof, and including at least two holes formed in the upper end of said board;

b) means for attaching the rigid board to a vertical surface;

c) a flat, flexible transparent sheet comprising a laminate of a polyester sheet and a dry-erase ink retaining film including at least two holes formed in the upper end of said transparent sheet, said holes in said transparent sheet being in registry with said holes in said rigid plastic board;

d) a sheet of opaque material on which information may be printed inserted between said transparent sheet and said rigid board and removable for periodic replacement, said printed material comprising a template to permit the recording of hand-written messages in a specific and meaningful position on said transparent sheet; and e) a pair of plastic plugs including a body of the same approximate diameter as said holes in said rigid board and said transparent sheet, each plug having a head, said plugs press-fit into said holes to attach said transparent sheet to said rigid board, said plugs being easily pushed out of said holes for replacement of said transparent sheet on said rigid board.

* * * * *